US006571525B2

(12) United States Patent
Coleman

(10) Patent No.: US 6,571,525 B2
(45) Date of Patent: Jun. 3, 2003

(54) CONSTRUCTION BLOCK

(76) Inventor: J. David Coleman, 1168 Country Club Rd., Dandridge, TN (US) 37725

( * ) Notice: Subject to any disclaimer, the term of this patent is extended or adjusted under 35 U.S.C. 154(b) by 0 days.

(21) Appl. No.: 09/920,477

(22) Filed: Aug. 1, 2001

(65) Prior Publication Data

US 2003/0029119 A1 Feb. 13, 2003

(51) Int. Cl.[7] ..... E04B 2/18

(52) U.S. Cl. ..... 52/592.5; 52/591.1; 52/592.1; 52/592.6; 446/125; 446/126; 446/128

(58) Field of Search ..... 52/603–608, 592.6, 52/592.5, 592.3, 592.2, 590.3, 590.2, 592.4, 589.1, 591.1; 446/124, 125, 128, 121, 126

(56) References Cited

U.S. PATENT DOCUMENTS

| | | | | |
|---|---|---|---|---|
| 349,646 | A | | 9/1886 | Grigg |
| 460,177 | A | | 9/1891 | Cook |
| 786,884 | A | * | 4/1905 | Faulkner |
| 2,461,535 | A | | 2/1949 | Erhardt |
| 3,005,282 | A | | 10/1961 | Christiansen |
| 3,034,254 | A | | 5/1962 | Christiansen |
| 3,148,477 | A | * | 9/1964 | Bjorn et al. |
| 3,162,973 | A | | 12/1964 | Christiansen |
| 3,224,135 | A | | 12/1965 | Wright et al. |
| 3,405,479 | A | * | 10/1968 | Paulson |
| 3,597,875 | A | | 8/1971 | Christiansen |
| 3,668,832 | A | | 6/1972 | Harman |
| 3,962,842 | A | | 6/1976 | Wilhelm |
| 4,582,495 | A | * | 4/1986 | Orgass et al. ..... 446/102 |
| 4,919,635 | A | | 4/1990 | Bertrand |
| 5,238,231 | A | | 8/1993 | Huang |
| 5,471,808 | A | * | 12/1995 | De Pieri et al. ..... 52/603 |
| 5,813,186 | A | | 9/1998 | Acksel |
| 5,816,749 | A | | 10/1998 | Bailey, II |
| 5,848,927 | A | | 12/1998 | Frederiksen |
| 5,901,520 | A | | 5/1999 | Abdul-Baki |
| 5,987,840 | A | | 11/1999 | Leppert |
| 6,050,044 | A | * | 4/2000 | McIntosh ..... 52/591.1 |
| 6,050,873 | A | | 4/2000 | Reisman |
| 6,088,987 | A | * | 7/2000 | Simmons et al. ..... 52/592.6 |
| 6,161,357 | A | * | 12/2000 | Altemus ..... 52/592.6 |
| 6,162,108 | A | | 12/2000 | Frederiksen |

OTHER PUBLICATIONS

Prior Art—Block (3 pages).

* cited by examiner

*Primary Examiner*—Carl D. Friedman
*Assistant Examiner*—Yvonne M. Horton
(74) *Attorney, Agent, or Firm*—Luedeka, Neely & Graham, PC

(57) ABSTRACT

A system for modular construction provided by interconnectable and stackable polymeric blocks having end and side walls connected to a top wall, and exterior and interior cylinders. The exterior cylinders are matable with the interior cylinders of a connecting block, and apertures in the top wall allow for re-bar, conduit or installation of insulation. Raised ribs located adjacent to the top wall contact the connecting block to further enhance stability of the erected structure.

21 Claims, 10 Drawing Sheets

CONSTRUCTION BLOCK

FIELD OF THE INVENTION

This invention relates generally to construction materials. More particularly, this invention relates to modular construction materials.

BACKGROUND AND SUMMARY OF THE INVENTION

It is desirable to have a system for modular construction that enables structures to be quickly and easily erected, yet have desirable strength and durability. Attempts have been made to provide modular construction systems, however, these systems are generally disadvantageous as they are difficult to install and/or have undesirable strength and durability characteristics.

Accordingly, the present invention is directed to an improved construction block system.

In a preferred embodiment, the system includes a plurality of interconnectable and stackable blocks each having a height. Each block includes a plurality of end and side walls connected to a top wall so as to define a blind bore and a plurality of interior cylinders located within the blind bore. Each interior cylinder having a longitudinal axis substantially aligned with the height of the block and a length of substantially equal length to the height of the block, A plurality of exterior cylinders are located adjacent to the top wall, each exterior cylinder being substantially concentric with one of the interior cylinders and having a length corresponding to a desired ratio relative to the height of the block. A plurality of apertures are located adjacent the top surface, each aperture being concentric with one of the exterior cylinders and one of the interior cylinders so as to permit access there between. A plurality of raised ribs are located adjacent to the top wall, each rib substantially surrounding one of the exterior cylinders.

The system advantageously enables construction of wall structures using relatively lightweight yet sturdy components. Furthermore, the system enables re-bar to be used to further enhance strength characteristics of the wall. Also, the system advantageously enables electrical and water conduit to be installed in the wall, as well as enabling the wall to be insulated as by injecting a foam-type insulation.

BRIEF DESCRIPTION OF THE DRAWINGS

Further advantages of the invention will become apparent by reference to the detailed description of preferred embodiments when considered in conjunction with the figures, which are not to scale, wherein like reference numbers, indicate like elements through the several views, and wherein.

DETAILED DESCRIPTION

Figure 1:
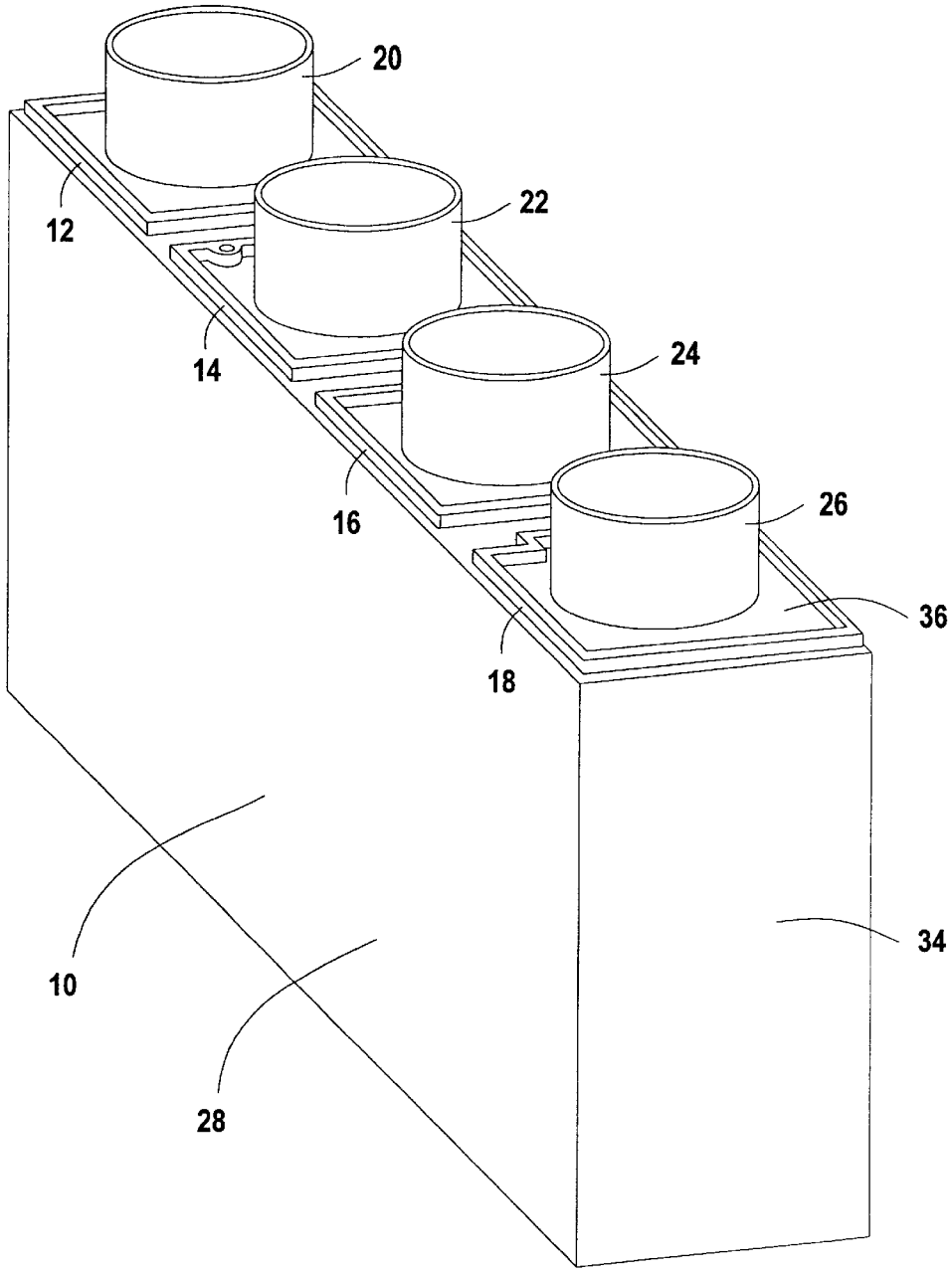
FIG. 1 is a perspective view of a preferred embodiment of a modular component of a construction block system in accordance with the invention.
Figure 2:
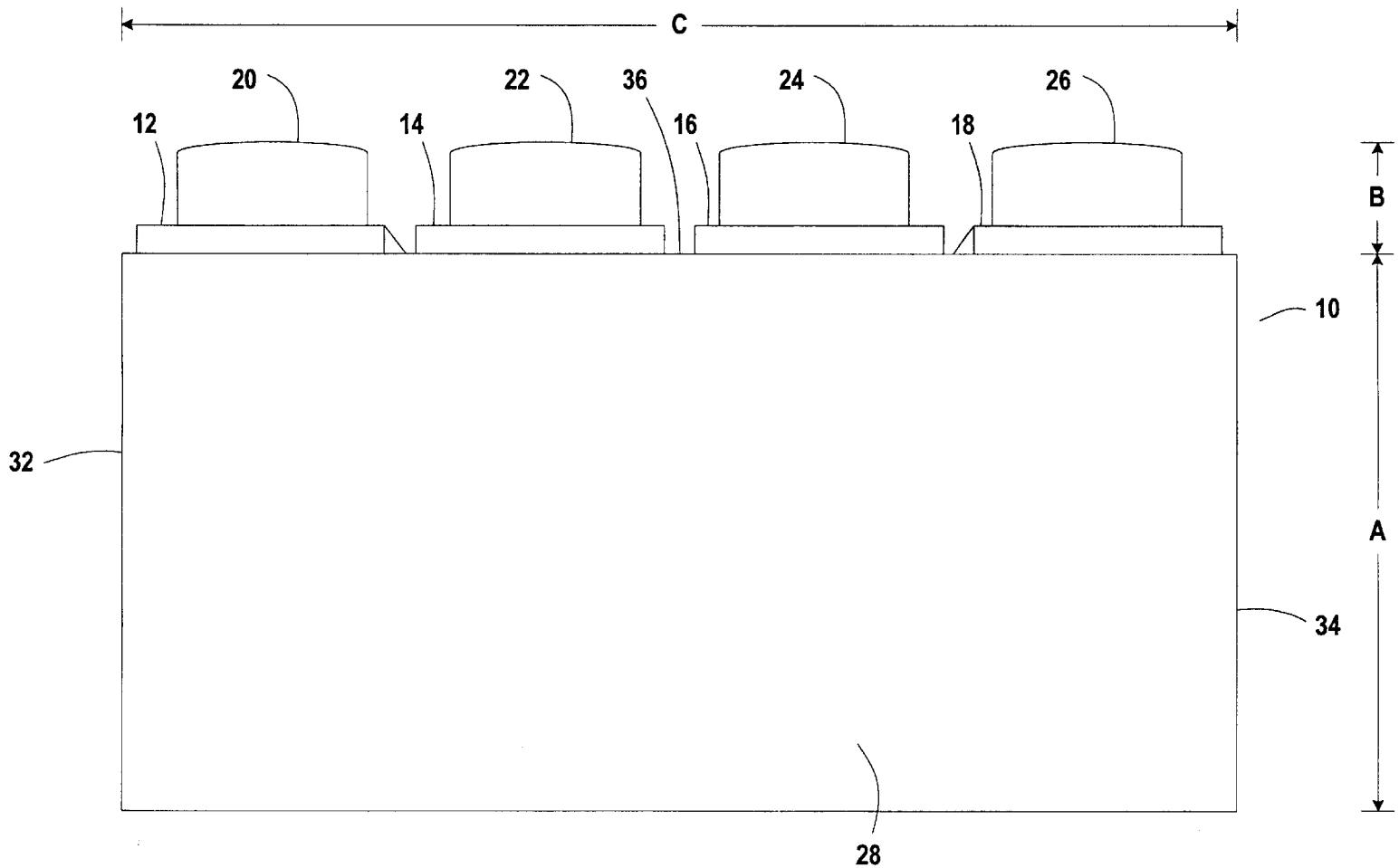
FIG. 2 is a side view of the component of FIG. 1.
Figure 3:
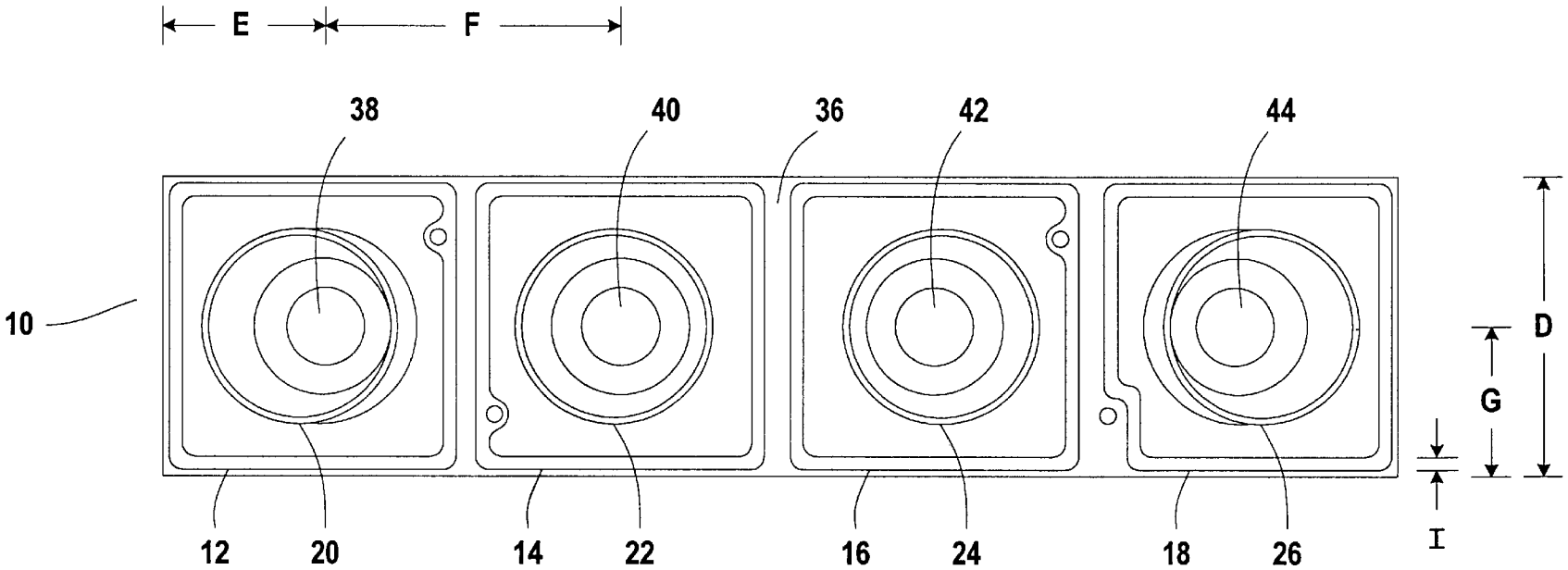
FIG. 3 is a top view of the component of FIG. 1.
Figure 4:
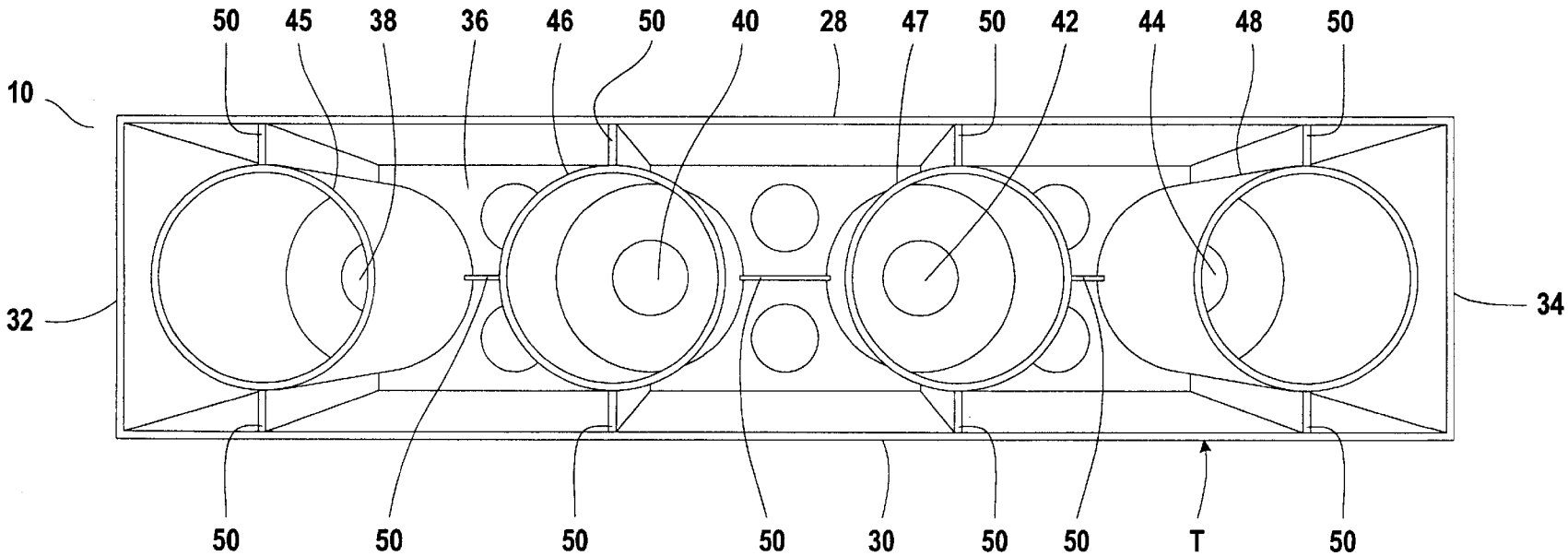
FIG. 4 is a bottom view of the component of FIG. 1.

With reference to the drawings, the invention relates to a modular construction block system provided by interconnectable and stackable block units. The block units are relatively light in weight, yet interconnect in a manner that results in a relatively stable and durable structure. In addition, the block components are preferably of one-piece molded plastic or polymer construction and configured to enable a structure having wiring, plumbing, insulation, and the like located internally therein.

Accordingly, and with reference to FIGS. 1–4, there is shown a modular construction block 10 in accordance with the invention. In a preferred embodiment, each block 10 is preferably rectangular or square in profile and includes a pair of opposite side walls 28 and 30, a pair of opposite end walls 32 and 34 and a cover wall 36 connected to the uppermost edge of each of the side and end walls, such that the interior of the block is a blind bore open at the bottom. The walls 28–36 of the block 10 preferably have a thickness from about 1/16 inch to about ½ inch, most preferably about ⅛ inch.

A plurality of interior cylinders 45, 46, 47, and 48 are located within the blind bore and are concentric with corresponding cylinders 20, 22, 24, and 26 extending upwardly from the cover wall 36. Apertures 38, 40, 42, and 44 are preferably provided on the cover wall 36 between each interior cylinder 45–48 and each exterior cylinder 20–26 and located to be concentric therewith. The apertures 38–42 advantageously can receive re-bar or water or electrical conduit or facilitate installation of insulation, such as foam-type insulation, into the blocks. The cylinders and apertures are described as circular, however, it will be understood that they may be of other configuration, such as of square configuration. Accordingly, as used herein and in the claims, the term "cylinder" will be understood to refer to an elongate hollow structure and not limited to a particular sidewall shape. That is, the cylinders may have a rectangular, square, circular or other cross-sectional shape. Likewise, the term "aperture" refers to an opening and is not limited to any particular shape.

Each of the interior cylinders 45–48 preferably has a length substantially corresponding to the height of the block. The exterior cylinders 20–26 each preferably has a height selected to be within a desired ratio relative to the height of the block. For example, the ratio of each cylinder 20–26 to the height of the block is preferably from about ⅓ to about ⅛, and most preferably about ⅙. It has been discovered that configuring the relative heights in this manner offers desirable stacking and strength characteristics.

Internal ribs 50 preferably extend between each interior cylinder and each side wall for improving rigidity and strength characteristics. Also, raised ribs 12, 14, 16, and 18, preferably arranged in a generally square configuration, preferably substantially surrounds each of the exterior cylinders 20–26, respectively, and is inset from the edges of the block so that the exterior edges of the ridges will have a tight fit with walls 28–36 of a connecting block. Each raised rib 12–18 preferably has a height of from about ⅛ inch to about ½ inch, most preferably about ¼ inch and a width of from about 1/16 inch to about ¼ inch, most preferably about ⅛ inch. It will be understood that the ribs contact internal surfaces of the walls and/or surfaces of the interior cylinders of the block stacked thereon. This advantageously inhibits relative movement such as tipping or sliding of the stacked block. Accordingly, it will be understood that other layouts of the ribs may likewise perform this function, particularly in the case of other than rectangular block configurations.

For the purpose of an example, the block 10 of FIG. 1 is preferably dimensioned as set forth in Table 1 below for use in construction. However, it will be appreciated that the blocks may be provided in various configurations and dimensions to enable its use in various construction applications.

TABLE 1

| Dimension | Distance (inches) |
|---|---|
| A | 6 |
| B | 1 |
| C | 12 |
| D | 2 |
| E | 1.5 |
| F | 3 |
| G | 1 |
| H | ⅛ |

Figure 5:
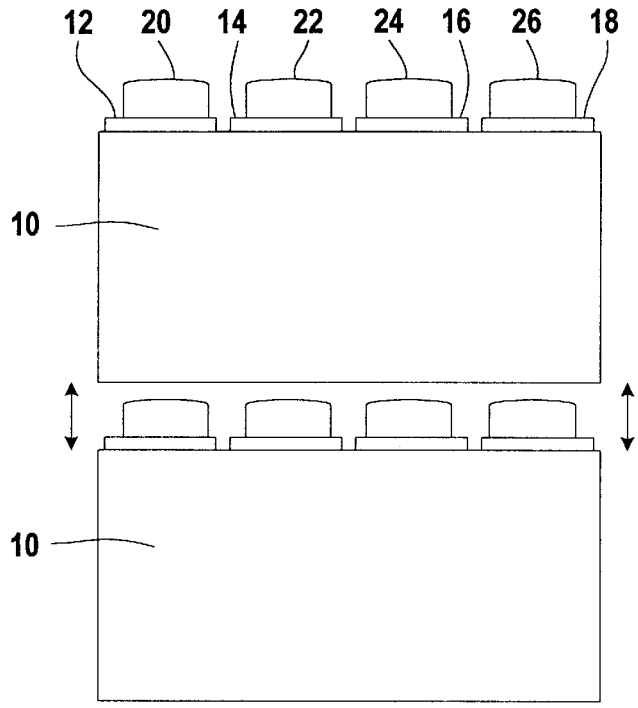
FIG. 5 is a side view showing a pair of the components of FIG. 1 prior to their mating.
Figure 6:
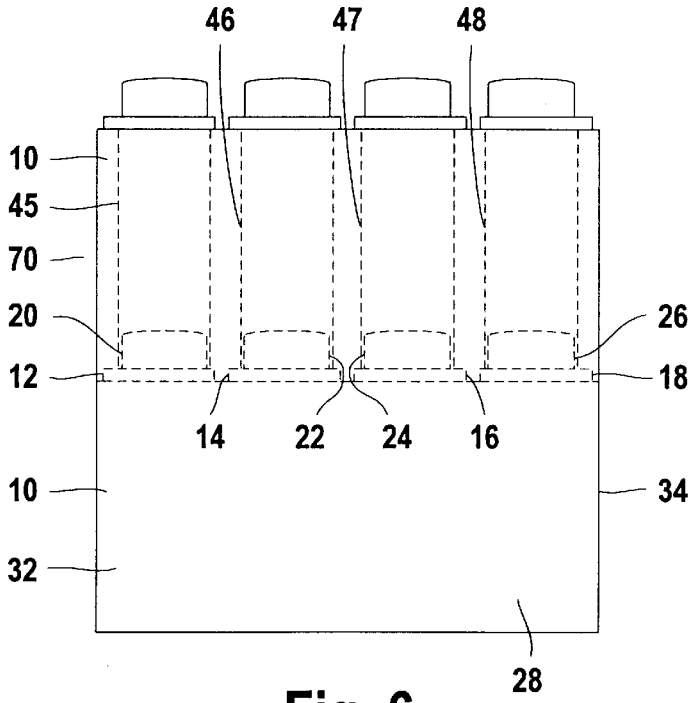
FIG. 6 is a side view of the components of FIG. 5 in a mating relationship.
Figure 7:
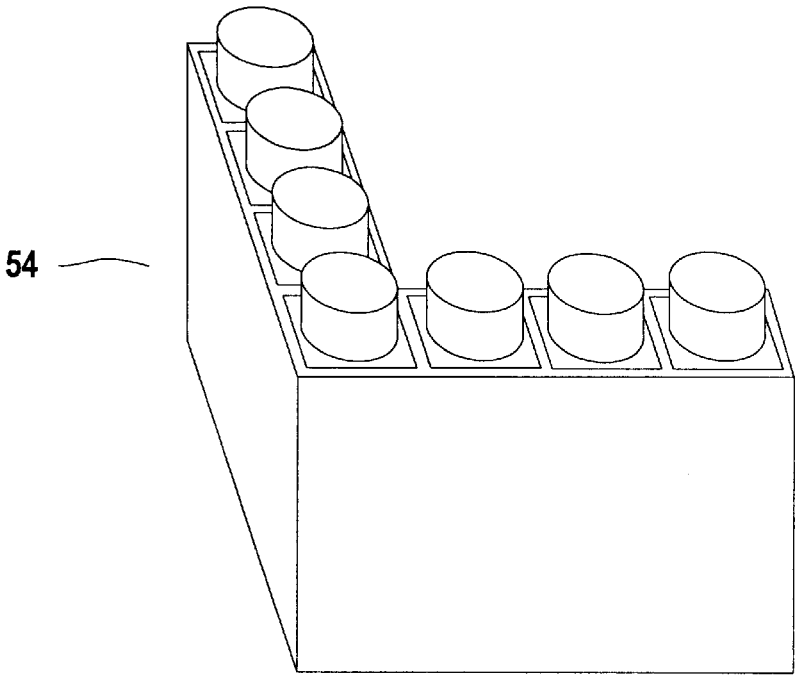
FIG. 7 is a perspective view of another embodiment of a block member in accordance with the invention and having an L-shaped configuration.
Figure 7A:
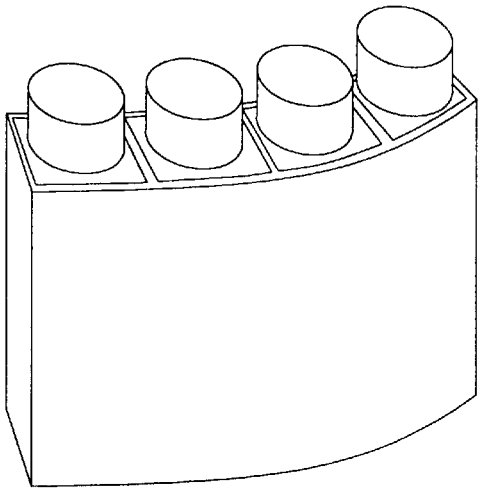
FIG. 7*a* shows another embodiment of a block member having a curved configuration.
Figure 7B:
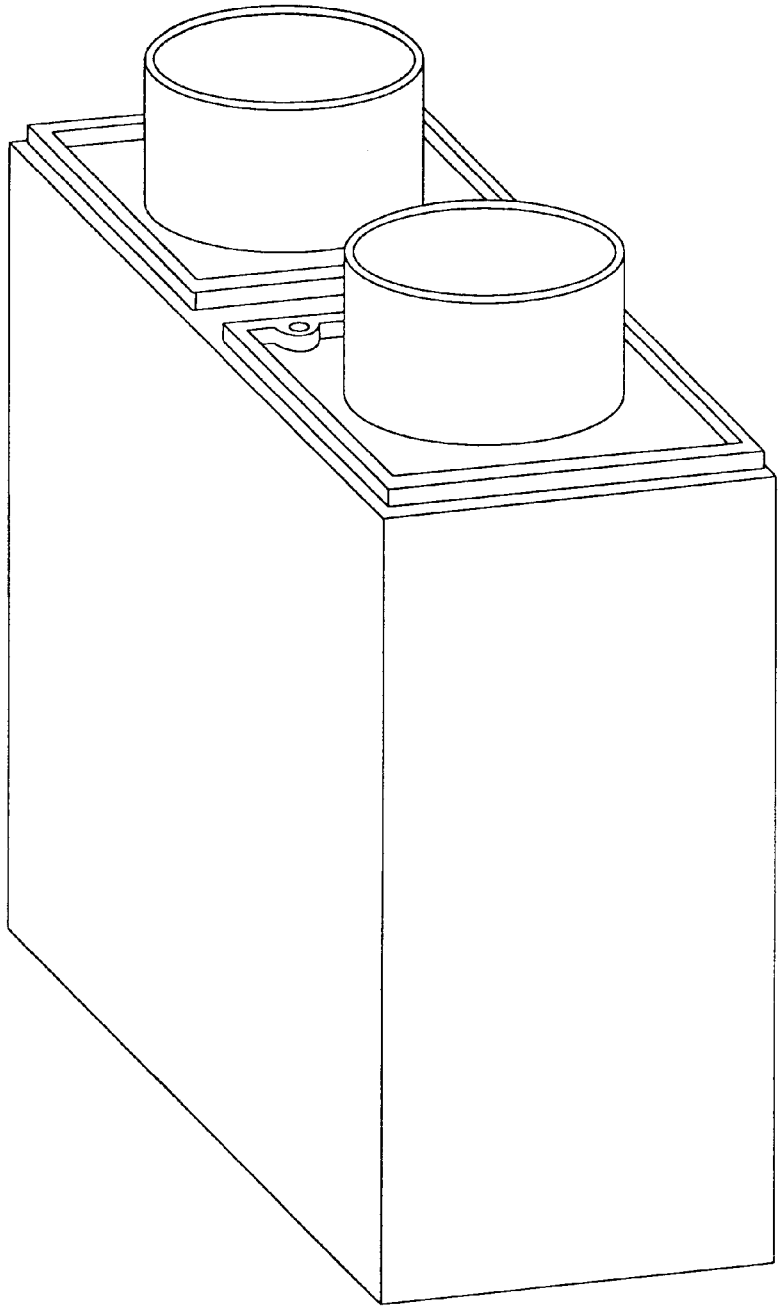
FIG. 7*b* shows a block member as in FIG. 1, yet of a smaller dimension.

With continuing reference to FIG. 1 and with reference to FIGS. 5 and 6, each block 10 may be joined together with another block of the same or different configuration (i.e., straight, curved or angled) to enable a construction block system 70 of virtually any length or configuration. To this end, a lower end of each interior cylinder 45–48 preferably mates with exterior cylinders 20–26, respectively, of an adjoining block. The cylinders are fittingly received by one another to form a tight connection which provides advantageous stability and strength characteristics to the resulting structure. Maintaining the desired ratio of the height of the block to the height or length of the exterior cylinders advantageously enhances the friction interconnections and side-to-side stability desirable for construction purposes. Additionally, as noted above, the ribs 12–18 of each block are preferably positioned to just clear the interior outline of the bottom of the block being stacked thereon, so as to offer additional frictional engagement with the interior walls 28–34 of the block as well as inhibiting relative rotational and other movement. Accordingly, it will be appreciated that each block 10 may be provided in virtually any length and may be shaped to conform to a particular construction application. For example, and with reference to FIG. 7, corner block 54 is provided in an L-shaped or 90° angle configuration which can be used in conjunction with straight blocks to form cornered construction block configurations. However, it will be understood that the blocks may be provided in various other shapes, such as other angular configurations or curved. For example, FIG. 7*a* shows a curved block 55, and FIG. 7*b* shows a block 10' that is substantially identical to block 10, but having a reduced length.

Figure 8A:
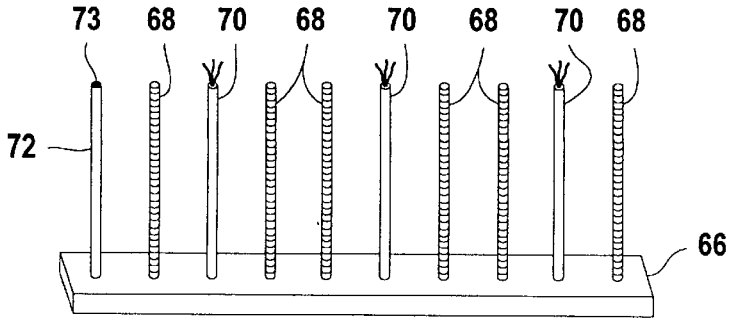
FIG. 8*a* is a perspective view of a preferred embodiment of a wall foundation having re-bar and conduit installed thereon for receiving modular components in accordance with the invention for construction of a wall.

The present invention offers significant advantages over prior construction block systems in that it is convenient to use, provides improved strength and support, and avoids many disadvantages of prior construction block systems. For example, FIGS. 8*a–c* illustrate use of the construction block system for construction of a landscaping wall 62 (FIG. 8*c) or other structure having walls.*

Returning to FIG. 8*a*, a foundation 64 is preferably initially prepared as by preparing a concrete footer 66 having re-bar 68 and conduit, such as electrical conduit 70 in electrical communication with a power source, or water or other plumbing conduit 72 (having capped end 73) that may be in fluid communication with a water source for supplying water or a sewer source for draining purposes.

Figure 8B:
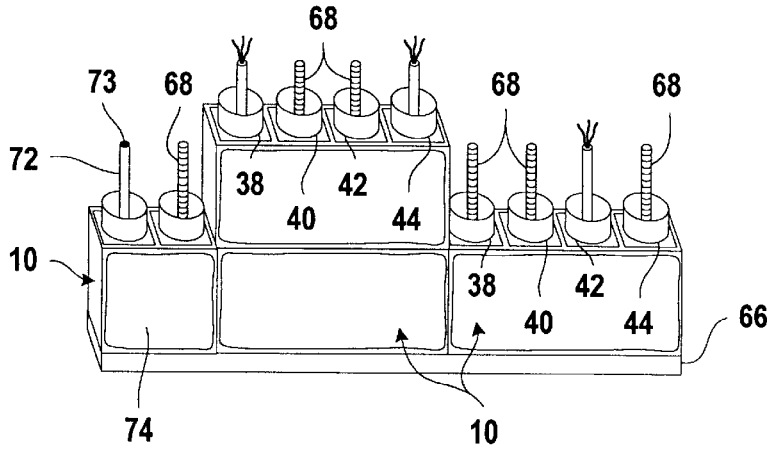
FIG. 8*b* is a perspective view of the foundation of FIG. 8*a* showing partial installation of modular components in accordance with the invention.

FIG. 8*b* shows the wall 62 during construction wherein the blocks 10 are stacked upon and adjacent to one another in accordance with the invention. As will be noted, the apertures 38–44 of the cylinders receive the re-bar 68, conduit 70 and conduit 72. It is further noted that each block 10 and 10' preferably has a front surface 74 configured to include decorative topography so as to simulate brick or stone. In this regard, it is further noted that the blocks may be painted or otherwise provided in a color resembling the material to be imitated.

Figure 8C:
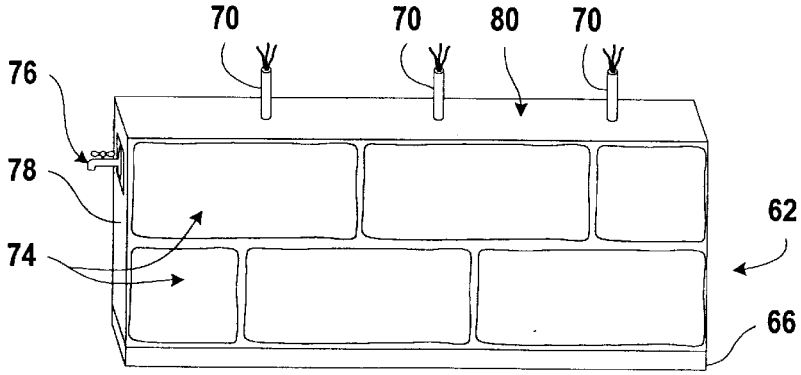
FIG. 8*c* is a perspective view of a finished wall consisting of modular components of the invention.

FIG. 8*c* shows the erected wall 62. As will be noted, a spigot 76 has been installed on a surface 78 of one of the blocks 10' adjacent to and in flow communication with the water conduit 72. The spigot may be installed as but cutting a port or aperture in the surface 78 to allow access to the conduit 72. Also, it will be noted that the electrical conduits 70 preferably extend above upper planar surface 80 of the wall 62 to facilitate installation of lamps or other desired electrical devices on the surface 80. Alternatively, it will be understood that the electrical/water connections can be made through other surfaces of the blocks.

Figure 8D:
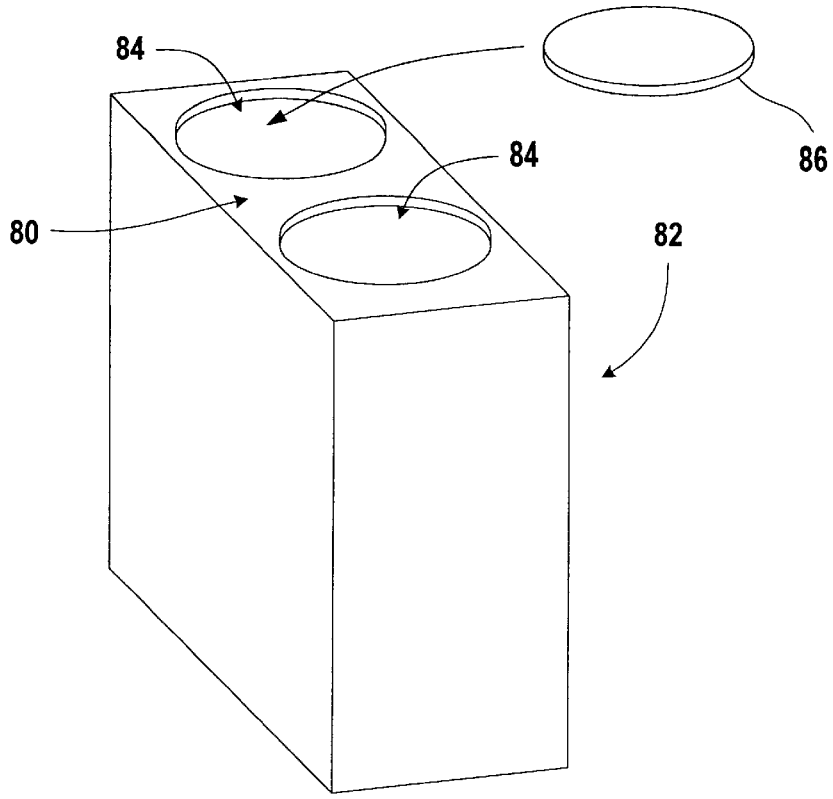
FIG. 8*d* is a perspective view of a topper block.
Figure 8E:
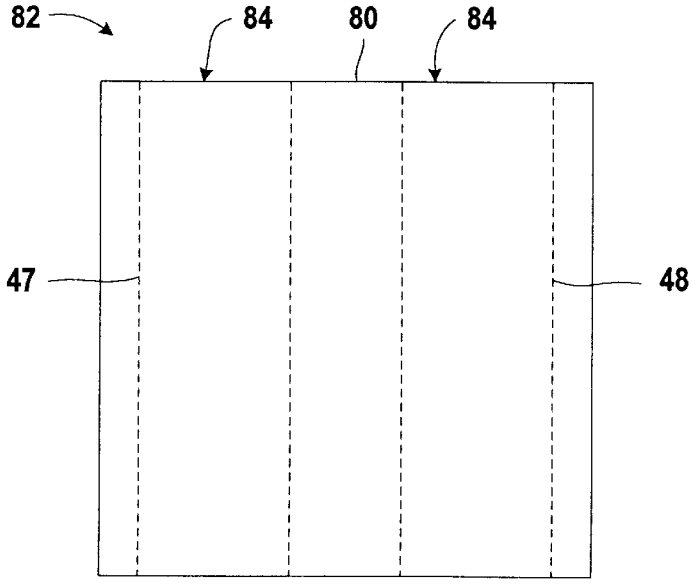
FIG. 8*e* is a side view of the topper block of FIG. 8*d*.

FIGS. 8*d* and 8*e* show a topper block 82 that may be stacked onto the blocks to provide the surface 80. As will be noted, the block 82 is substantially similar to the other previously described blocks, but does not include the exterior cylinders 20–26 Apertures, such as apertures 84, may be drilled through the surface 80 if desired for receiving conduits or re-bar, if desired Alternatively, the apertures may be pre-formed during manufacture of the blocks, and capped as with a corresponding cap 86.

Figure 9:
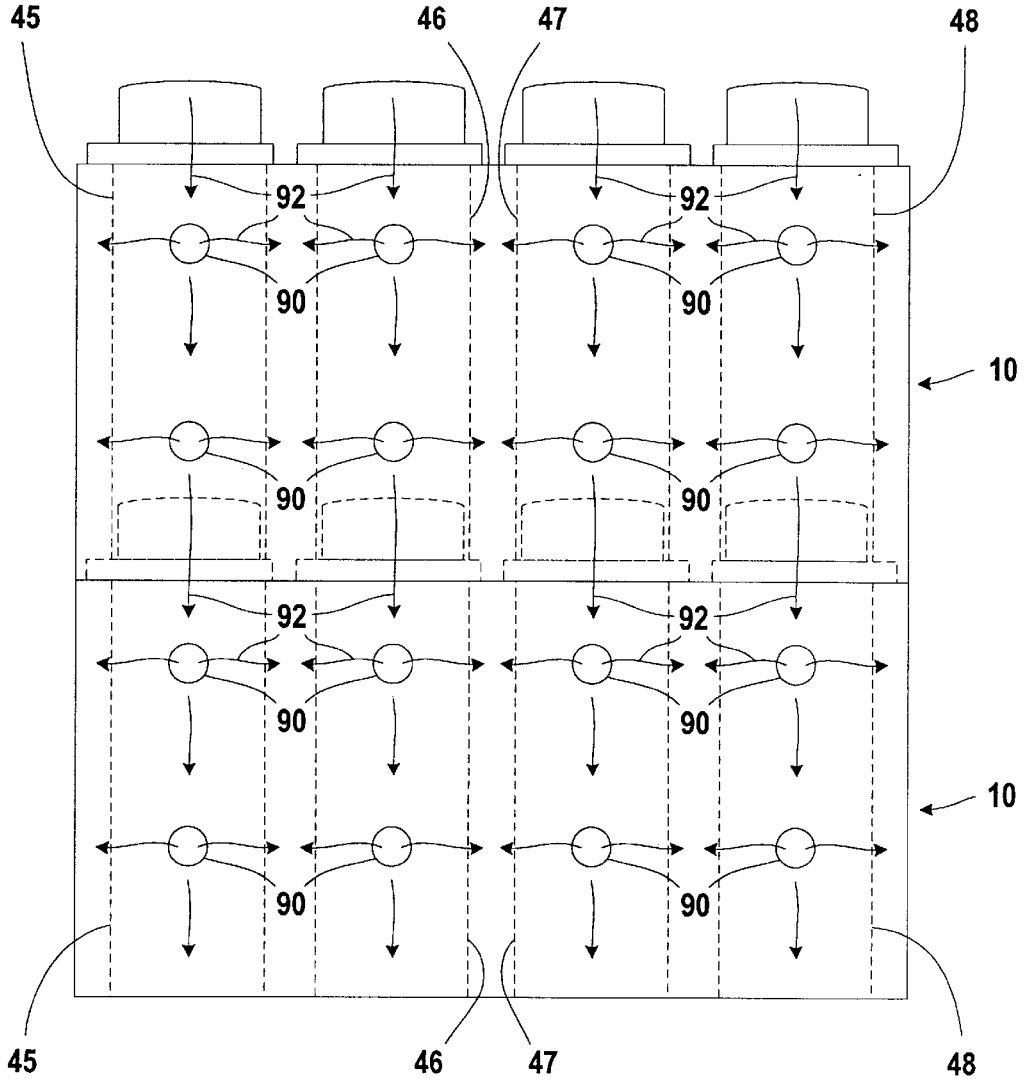
FIG. 9 shows an alternate block configuration that facilitates the introduction of a foam type insulation.

If it is desired to use the blocks for structures which are to be insulated, it will be understood that insulation, preferably foam-type insulation, may be introduced into the apertures. In such cases, and with reference to FIG. 9, it is preferred that the interior cylinders 45–48 be provided with additional slits 90 or other vent or aperture structure so as to facilitate migration of the insulation. For example, foam insulation may be introduced though the apertures 82 and migrate through the cylinders and also to other interior portions of the blocks via the slits 90, as indicated by arrows 92.

The foregoing description of certain exemplary embodiments of the present invention has been provided for purposes of illustration only, and it is understood that numerous modifications or alterations may be made in and to the illustrated embodiments without departing from the spirit and scope of the invention as defined in the following claims.

What is claimed is:

1. A modular construction block system, comprising:

a plurality of interconnectable and stackable blocks each having a height, each block comprising a plurality of end and side walls connected to a top wall so as to define a blind bore, a plurality of interior cylinders located within the blind bore, each interior cylinder having a longitudinal axis substantially aligned with the height of the block and a length of substantially equal length to the height of the block, a plurality of exterior cylinders located adjacent to the top wall, each exterior cylinder being substantially concentric with one of the interior cylinders and having a length corresponding to a desired ratio relative to the height of the block, a plurality of apertures adjacent the top surface, each aperture being concentric with one of the exterior cylinders and one of the interior cylinders so as to permit access there between, and a plurality of raised ribs located adjacent to the top wall, each rib substantially surrounding one of the exterior cylinders, with the raised ribs arranged in a square configuration, substantially centered on the exterior cylinders and inset from the edge of the block so that exterior edges of the ridges will contact another of the blocks stacked on an underlying block.

2. The system of claim 1, wherein the interior and exterior cylinders and the apertures there between are configured to receive re-bar or electrical conduit or water conduit.

3. The system of claim 1, further comprising a plurality of apertures extending through a sidewall of at least one of the interior cylinders.

4. The system of claim 1, further comprising a topper block stackable on one of the blocks of the system, the topper block comprising a plurality of end and side walls connected to a top wall so as to define a blind bore, and a plurality of interior cylinders located within the blind bore, each interior cylinder having a longitudinal axis substantially aligned with the height of the block and a length of substantially equal length to the height of the block.

5. The system of claim 1, wherein an exterior portion of at least one of the sidewalls of one of the blocks is configured to have a non-planar decorative topography.

6. The system of claim 1, wherein the interior and exterior cylinders are of substantially circular cross-section.

7. The system of claim 1, wherein each block is substantially rectangular in cross-section.

8. The system of claim 1, wherein the ratio of the length of each exterior cylinder to the height of its block is from about ⅓ to about ⅛.

9. A wall structure, comprising a plurality of interconnected and stacked block units, each block unit comprising a plurality of end and side walls connected to a top wall so as to define a blind bore, a plurality of interior cylinders located within the blind bore, each interior cylinder having a longitudinal axis substantially aligned with the height of the block and a length of substantially equal length to the height of the block, a plurality of exterior cylinders located adjacent to the top wall, each exterior cylinder being substantially concentric with one of the interior cylinders and having a length corresponding to a desired ratio relative to the height of the block, a plurality of apertures adjacent the top surface, each aperture being concentric with one of the exterior cylinders and one of the interior cylinders so as to permit access there between, and a plurality of raised ribs located adjacent to the top wall, each rib substantially surrounding one of the exterior cylinders, with the raised ribs arranged in a square configuration, substantially centered on the exterior cylinders and inset from the edge of the block so that exterior edges of the ridges will contact another of the blocks stacked on an underlying block.

10. A modular construction block system, comprising:

a plurality of interconnectable and stackable blocks each having a height, each block comprising a plurality of end and side walls connected to a top wall so as to define a blind bore, a plurality of interior cylinders located within the blind bore, each interior cylinder having a longitudinal axis substantially aligned with the height of the block and a length of substantially equal length to the height of the block, a plurality of exterior cylinders located adjacent to the top wall, each exterior cylinder being substantially concentric with one of the interior cylinders and having a length corresponding to a desired ratio relative to the height of the block, a first aperture located within one of the exterior cylinders and extending through the top wall to place such exterior cylinder in flow communication with the interior cylinder with which it is concentric with, and a second aperture extending through a sidewall of the interior cylinder which is in flow communication with the exterior cylinder having the first aperture, the second aperture being in flow communication with the first aperture to permit a fluid to be introduced into the interior cylinder via the first aperture and migrate from the interior cylinder into the blind bore.

11. The system of claim 10, further comprising a plurality of raised ribs located adjacent to the top wall.

12. The system of claim 11, wherein the raised ribs are arranged in a square configuration, substantially centered on the exterior cylinders and inset from the edge of the block so that the exterior edges of the ridges will contact another of the blocks stacked on an underlying block.

13. The system of claim 10, wherein the interior and exterior cylinders and the first apertures there between are configured to receive re-bar or electrical conduit or water conduit.

14. The system of claim 10, further comprising a topper block stackable on one of the blocks of the system, the topper block comprising a plurality of end and side walls connected to a top wall so as to define a blind bore, and a plurality of interior cylinders located within the blind bore, each interior cylinder having a longitudinal axis substantially aligned with the height of the block and a length of substantially equal length to the height of the block.

15. The system of claim 10, wherein an exterior portion of at least one of the sidewalls of one of the blocks is configured to have a non-planar decorative topography.

16. The system of claim 10, wherein the interior and exterior cylinders are of substantially circular cross-section.

17. The system of claim 10, wherein each block is substantially rectangular in cross-section.

18. The system of claim 10, wherein the ratio of the length of each exterior cylinder to the height of its block is from about ⅓ to about ⅛.

19. A wall structure, comprising a plurality of interconnected and stacked block units, each block unit comprising a plurality of end and side walls connected to a top wall so as to define a blind bore, a plurality of interior cylinders located within the blind bore, each interior cylinder having a longitudinal axis substantially aligned with the height of the block and a length of substantially equal length to the height of the block, a plurality of exterior cylinders located adjacent to the top wall, each exterior cylinder being substantially concentric with one of the interior cylinders and having a length corresponding to a desired ratio relative to the height of the block, a first aperture located within one of the exterior cylinders and extending through the top wall to place such exterior cylinder in flow communication with the interior cylinder with which it is concentric with, and a second aperture extending through a sidewall of the interior cylinder which is in flow communication with the exterior cylinder having the first aperture, the second aperture being in flow communication with the first aperture to permit a fluid to be introduced into the interior cylinder via the first aperture and migrate from the interior cylinder into the blind bore.

20. The wall structure of claim 19, wherein each block unit further comprises a plurality of raised ribs located adjacent to the top wall.

21. A modular construction block system, comprising:

a plurality of interconnectable and stackable blocks each having a height, each block comprising a plurality of end and side walls connected to a top wall so as to define a blind bore, a plurality of interior cylinders located within the blind bore, each interior cylinder having a longitudinal axis substantially aligned with the height of the block and a length of substantially equal length to the height of the block, a plurality of exterior cylinders located adjacent to the top wall, each exterior cylinder being substantially concentric with one of the interior cylinders and having a length corresponding to a desired ratio relative to the height of the block, a plurality of first apertures adjacent the top surface, each aperture being concentric with one of the exterior cylinders and one of the interior cylinders so as to permit access there between, a plurality of second apertures extending through a sidewall of at least one of the interior cylinders, and a plurality of raised ribs located adjacent to the top wall and arranged in a square configuration, substantially centered on the exterior cylinders and inset from the edge of the block so that the exterior edges of the ridges will contact another of the blocks stacked on an underlying block.

* * * * *